US006918827B2

(12) United States Patent
Daniels et al.

(10) Patent No.: US 6,918,827 B2
(45) Date of Patent: Jul. 19, 2005

(54) UNIVERSAL CHIMNEY CAP

(75) Inventors: Robert Daniels, Vedic City, IA (US); Elvin D. Hediger, Lemont, IL (US); Clarence Allred, Robbins, NC (US); Robert Bishop, West End, NC (US)

(73) Assignee: Copperfield Chimney Supply, Inc., Fairfield, IA (US)

( * ) Notice: Subject to any disclaimer, the term of this patent is extended or adjusted under 35 U.S.C. 154(b) by 0 days.

(21) Appl. No.: 10/634,753

(22) Filed: Aug. 6, 2003

(65) Prior Publication Data

US 2005/0048895 A1 Mar. 3, 2005

(51) Int. Cl.[7] ..... F23J 13/08
(52) U.S. Cl. ..... 454/14; 110/119; 454/13
(58) Field of Search ..... 454/12, 13, 14; 110/119, 121

(56) References Cited

U.S. PATENT DOCUMENTS

| | | | | | |
|---|---|---|---|---|---|
| 976,849 | A | * | 11/1910 | Cochran | 454/24 |
| 2,188,709 | A | * | 1/1940 | Friedman | 454/21 |
| 2,260,452 | A | * | 10/1941 | Hart | 242/118.32 |
| 2,976,796 | A | | 3/1961 | Anthony et al. | |
| 4,334,460 | A | | 6/1982 | Simmons et al. | |
| 4,386,571 | A | * | 6/1983 | Dortzbach | 110/119 |
| 4,436,021 | A | | 3/1984 | Hisey | |
| 4,535,686 | A | | 8/1985 | Hisey | |
| 4,549,473 | A | | 10/1985 | Alexander et al. | |
| 4,697,500 | A | * | 10/1987 | Hisey | 454/35 |
| 4,732,078 | A | | 3/1988 | Giumenta et al. | |
| 5,025,712 | A | | 6/1991 | Perry | |
| 5,094,050 | A | * | 3/1992 | Jenkins | 52/218 |
| 6,022,269 | A | * | 2/2000 | Arbucci | 454/12 |

FOREIGN PATENT DOCUMENTS

| | | | | |
|---|---|---|---|---|
| AU | 23116 | * | 9/1930 | 110/119 |
| JP | 358167042 | * | 10/1983 | |

* cited by examiner

*Primary Examiner*—Harold Joyce
(74) *Attorney, Agent, or Firm*—Dickstein Shapiro Morin & Oshinsky LLP

(57) ABSTRACT

A chimney cap and a method for making the same are described. The chimney cap is more consistently and uniformly manufactured, which permits nesting. This is accomplished by forming the cap from single piece of expanded metal to create a substantially square or rectangular cage where each side of the cage has an integral flange that is bent substantially perpendicular to its respective side. The substantially square or rectangular cage is stretched to form a shaped trapezoidal cage, with a top portion of each side of the cage having a longer span that a bottom of portion of each side.

15 Claims, 11 Drawing Sheets

UNIVERSAL CHIMNEY CAP

BACKGROUND

The present invention relates generally to a chimney cap for protecting the upper open end of a chimney flue from the ingress of undesirable elements.

It is well known that chimney caps are often desired to prevent the ingress of undesirable elements into the upper end of the chimney flue. For example, the undesirable elements may include birds, squirrels and rain. It is also known that chimney caps are desired to prevent the egress of embers from the upper end of the chimney flue.

Various designs for chimney caps are known in the prior art. Most designs do not permit nesting of the caps and/or components for shipping and storage. Nesting can provide various advantages related to space. For example, nesting tops save a chimney sweep space in his vehicle. Nesting chimney caps and/or components can also save retailers and wholesalers storage space. Furthermore, manufacturers using caps and/or components that nest can reduce material handling and shipping costs, packaging requirements and storage space.

There is known in the related art, a chimney cap having a four-sided cage having rectangular cage components. See, for example, U.S. Pat. No. 4,549,473 (Alexander et al.), U.S. Pat. No. 4,535,686 (Hisey), U.S. Pat. No. 4,334,360 (Simmons et al.) and U.S. Pat. No. 2,976,796 (Anthony et al.). The resulting caps generally could not be easily nested because of their rectangular shape. Additionally, in certain chimney caps the studs used to secure the lid to the top of the cage are secured, e.g., welded, to brackets and the brackets are secured, e.g., welded, to the top of the cage. These brackets are also typically substantially right-angled in shape, having one leg substantially parallel to the side of the cage and one leg extending substantially perpendicular from the side into the interior of the cage. Consequently, these inconsistently shaped trapezoidal cages with angled brackets further made nesting difficult.

There is also known in the art chimney caps formed by cutting four trapezoidal sections of mesh and welding the four sections at the edges, leaving a trapezoidally-shaped cage. An undesired aspect of these chimney caps is a difficulty in manufacturing them with consistent results. Another undesired aspect is their odd appearance and the need for an excessively large lid.

Therefore it would be desirable to have consistently shaped, reasonably appearing caps that permit nesting.

SUMMARY

The invention provides an improved chimney cap that is more consistently and uniformly manufactured and permits nesting and a method for making the same. In one aspect, the chimney cap comprises a cage formed from one piece of substantially flat perforated rectangularly shaped metal, the metal being bent to form a substantially rectangularly configured box, opposites sides of the box being substantially similar in size, each side of the box having an integral flange that extends perpendicular to its respective side, and each side of the box being trapezoidal in shape, where each bottom span of the respective side of the box is smaller than the top span of the same respective side.

These and other features and advantages of the invention will be more readily understood from the following detailed description of the invention which is provided in connection with the accompanying drawings.

DETAILED DESCRIPTION OF PREFERRED EMBODIMENTS

Figure 1:
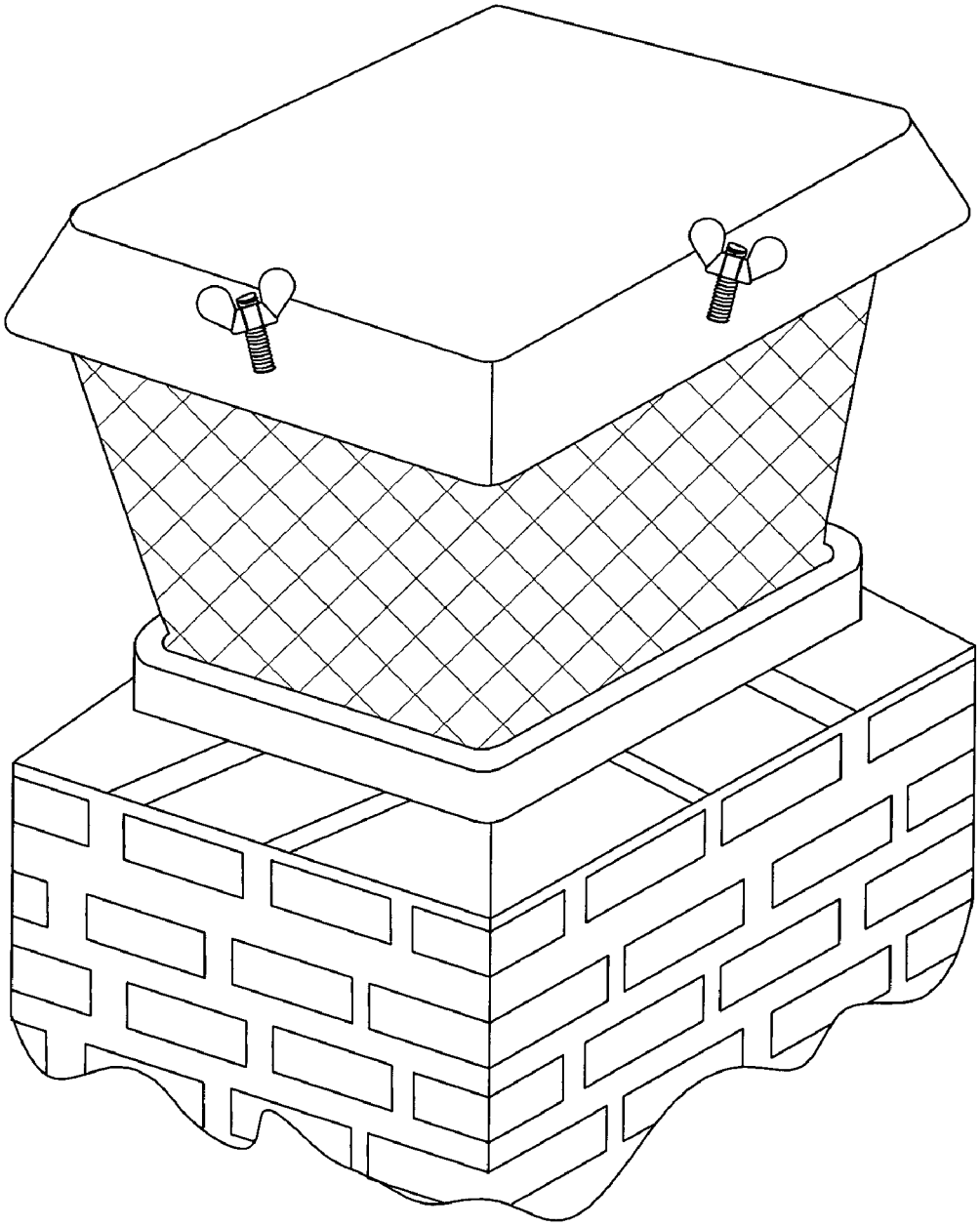
FIG. 1 is a perspective view of chimney cap according to a preferred embodiment of the present invention.
Figure 2:
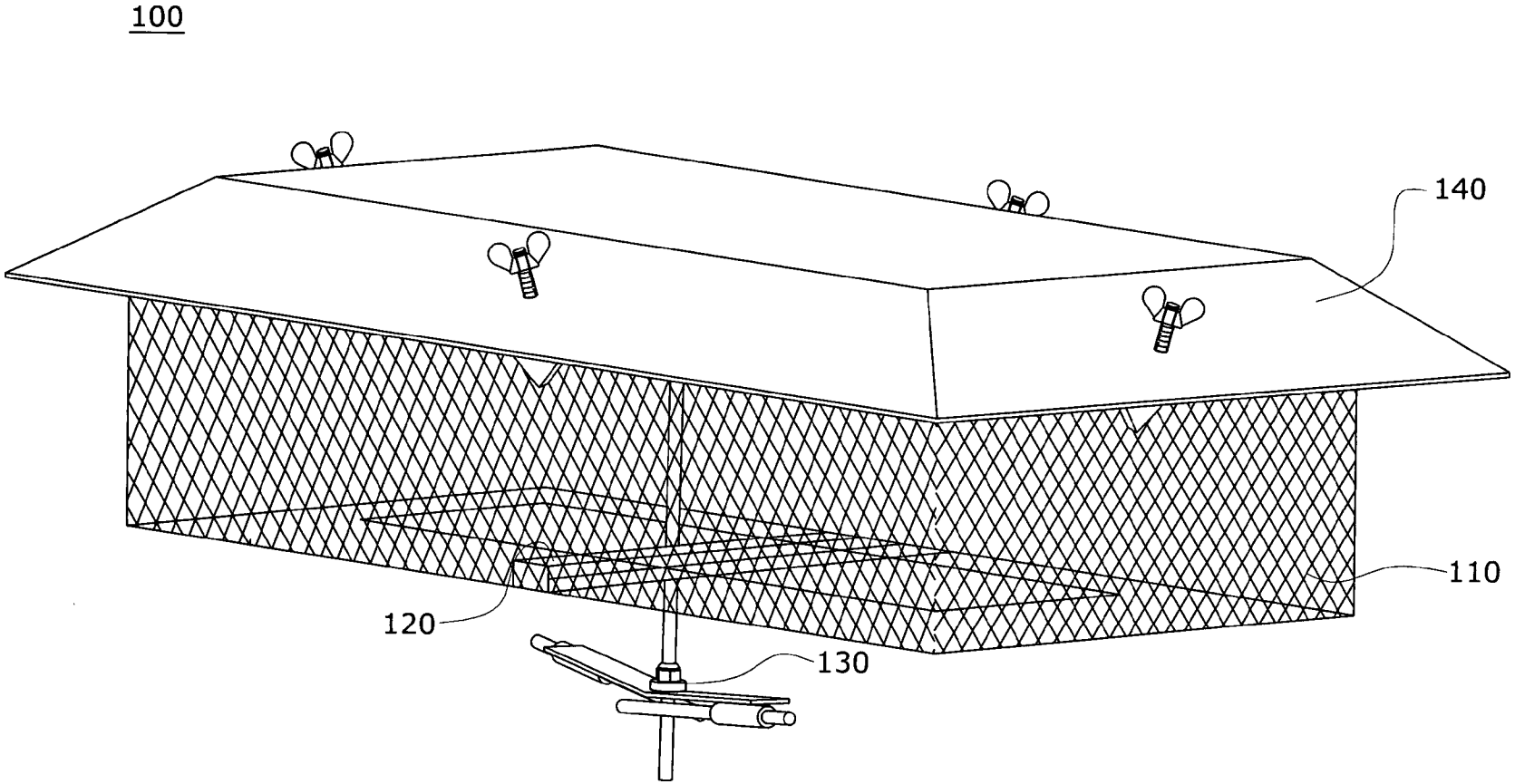
FIG. 2 is another perspective view of the cap of FIG. 1.

An embodiment of the present invention is seen in FIGS. 1 and 2 where a chimney cap 100 is shown including a cage 110, a strongback 120, a securing mechanism 130, and a lid 140. The cage 110 is an initially substantially rectangularly shaped figure having sides with perforations that permit the egress and ingress of limited elements. The lid 140 is disposed above the cage 110 and serves as the top of the chimney cap 100 and it is secured to the sides of cage 110. The strongback 120 is disposed within cage 110 and is secured to the lower interior of cage 110 and used to couple the cage 110 to the securing mechanism 130. The securing mechanism 130, disposed below cage 110, is connected to the chimney cap 100 through the strongback 120.

Figure 3:
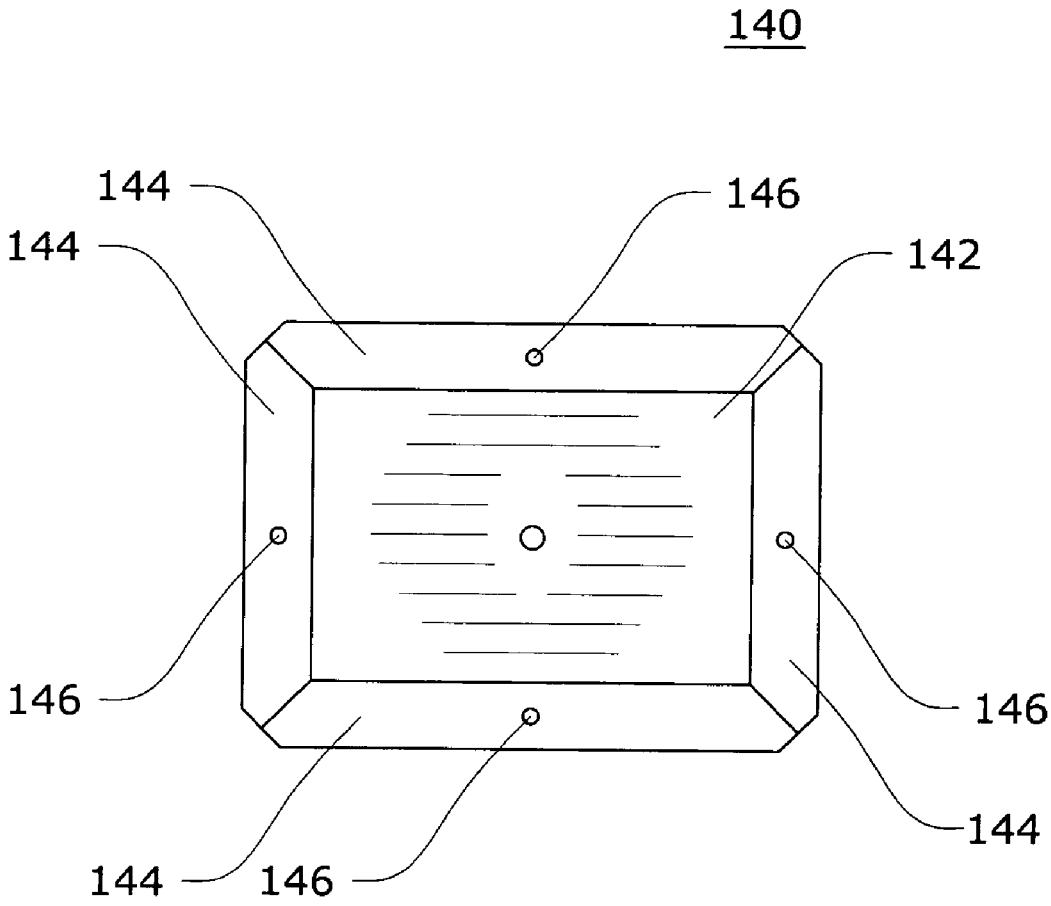
FIG. 3 is a top view of the lid in the cap of FIG. 1.

The lid 140 is shown in greater detail in FIG. 3. The lid 140 is preferably of sufficiently configured to prevent weather elements such as rain, snow or the like, from directly downwardly accessing a chimney flue. The lid 140 has a central flat area 142 and four sloped eves 144. The eves 144 are sloped top to bottom which minimizes the congregation of elements on the top side of the lid 140 and prevents elements from directly rolling off of the top side of the lid 140 into a chimney flue or the cage 110. In a preferred embodiment, the lid 140 is formed of twenty four (24) gauge stainless steel or galvaneal coated carbon steel. The perimeter of the lid 140 has a one hundred and eighty degree (180) rollover that is three-eighths (3/8) of an inch, where the roll is formed towards the underside of lid 140. Each eve 144 is a three (3) inch overhang that is sloped at a forty-five (45) degree downward angle. The lid 140 also has four (4) openings 146, i.e., holes, that are used to secure the lid 140 onto the cage 110.

As seen in FIGS. 1, 2, 4 and 5, the cage 110 is formed from a perforated material with perforations sufficiently large to permit air flow through the cage, but sufficiently small enough to reasonably prevent embers from egressing the chimney flue through the cage 110 and also to prevent the ingress of undesirable elements, e.g., small animals. The cage 110 is initially generally either substantially square or rectangular in shape. The cage 110 has four sides 112*a–d* which may all be of identical dimension and contour thereby forming a square-like cage. Alternatively, the sides 112*b* and 112*d* may both be either larger or smaller than the sides 112*a* and 112*c*, thereby presenting a rectangular cage. Cage 110 also has a side portion 112*e* (FIG. 5) adjacent to side 112*a* that overlaps, and is fastened to and therefore integral to, side 112*d*. Therefore, a general reference to side 112*d* of cage 110 is a collective reference to sides 112*d* and 112*e* after the side portion 112*e* is fastened to, and has become integral with, side 112*d*.

Figure 5:
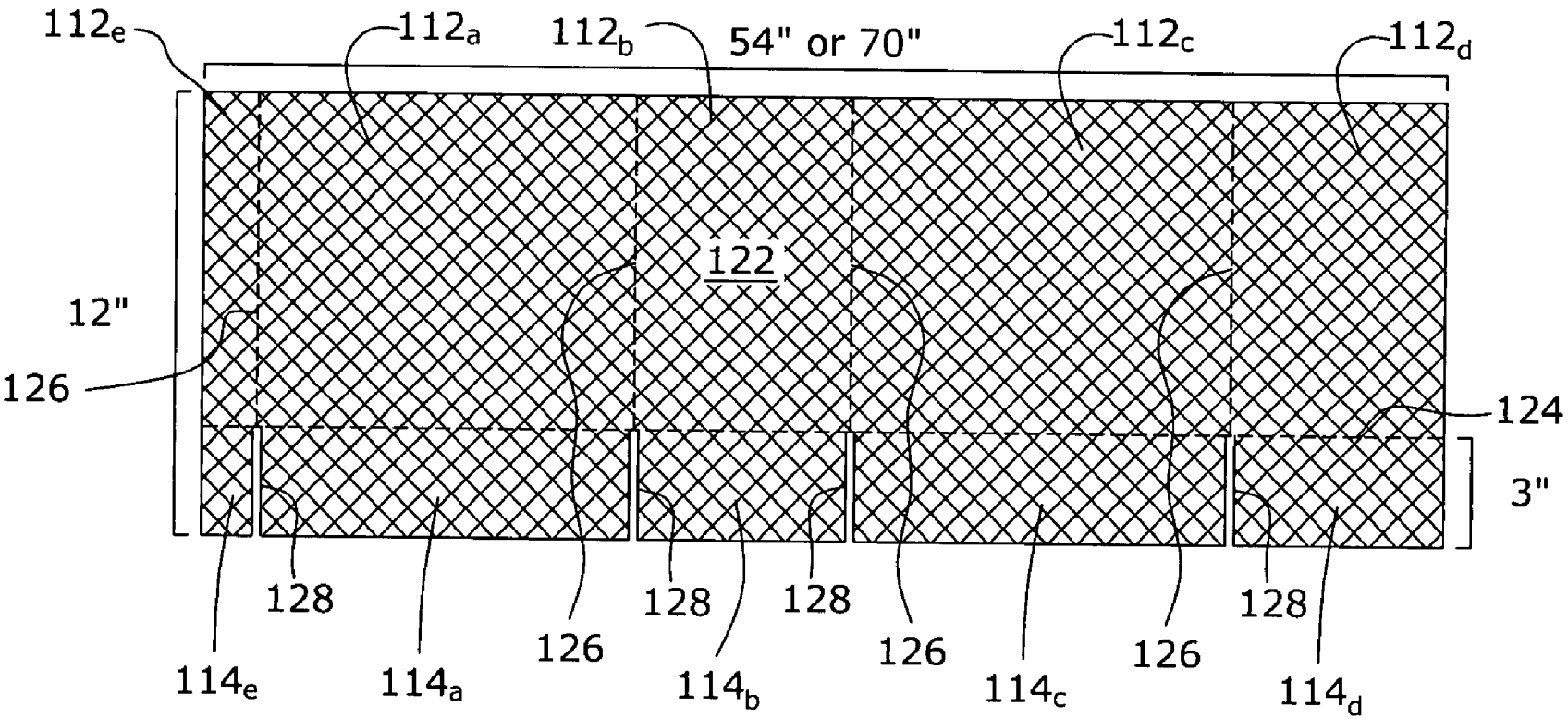
FIG. 5 is an exemplary embodiment the metal blank used to form a cage in the cap of FIG. 1.

The bottom open portion of the cage 110 is provided with four flanges 114*a–e*. The flanges 114*a–e* extend in part perpendicular to the respective sides 112*a–e* with which the flanges 114*a–e* are integral. For example as seen in FIG. 5, flange 114*a* is integral to side 112*a*. The flanges 114*a–e* serve to strengthen and support the sides 112*a–e*.

Referring to FIG. 5, the cage 110 is derived from a flat, metal mesh portion 122, i.e., a "blank." The metal mesh portion 122 is generally rectangular in configuration. In addition, the metal mesh portion 122 includes the flanges 114*a–e*. The metal mesh portion 122 is cut substantially along lines 128; preferably the length of each cut is the same and is substantially three inches. These cuts along lines 128 permit flanges 114*a–e* to be separated from one another. In a preferred embodiment, to form a substantially rectangularly shaped cage 110, the length of sides 112*a* and 112*c* are substantially the same and the length of sides 112*b* and 112*d* are substantially the same but different from the length of sides 112*a* and 112*c*. In a preferred embodiment, to form a substantially square shaped cage 110, the length of sides 112*a*, 112*b*, 112*c* and 112*d* are substantially the same. Side 112*e* preferably has a shorter length that side 112*d* but is sufficiently long enough to effectively fasten side 112*d* to side 112*a*.

Figure 4:
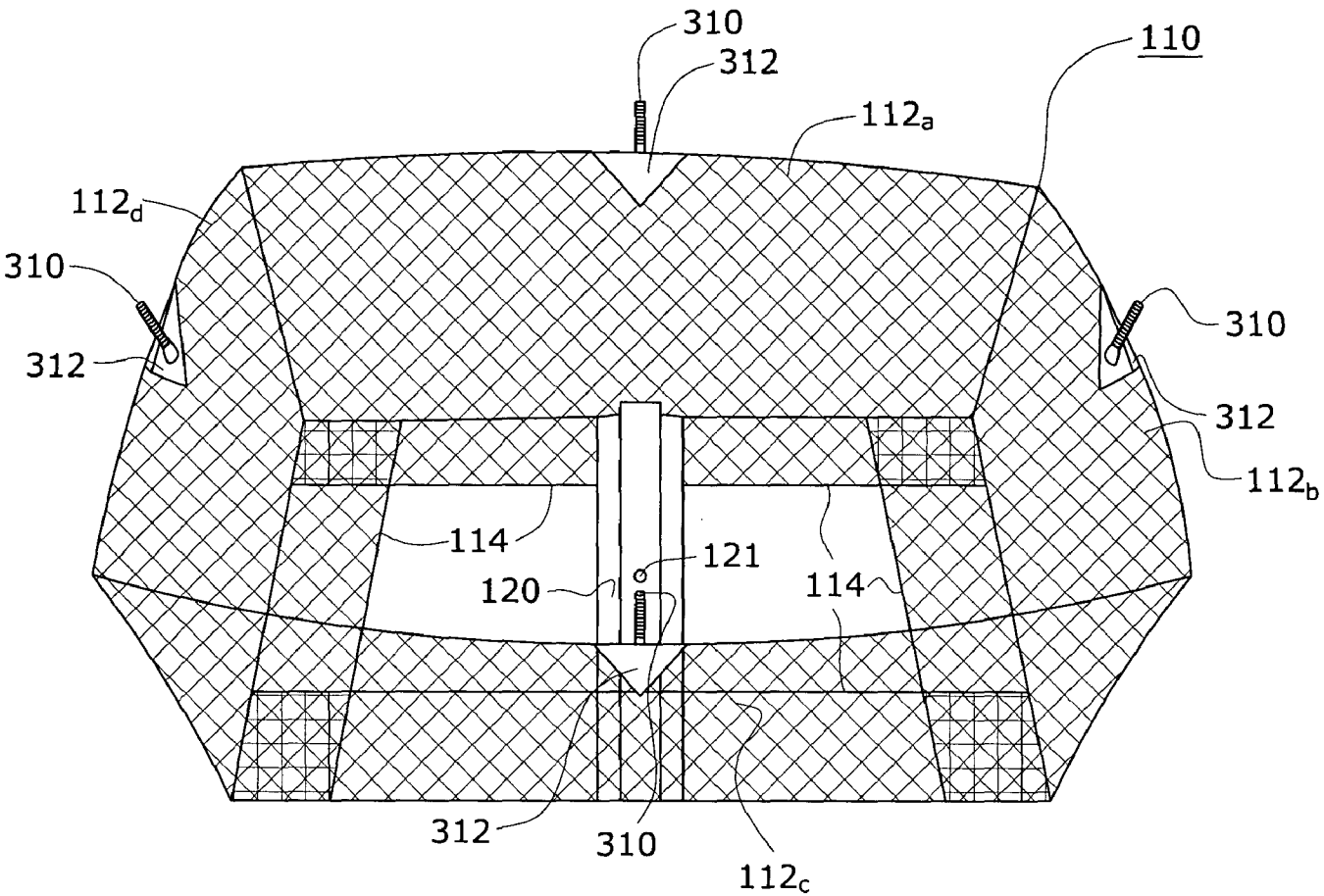
FIG. 4 is a perspective view of a cage in the cap of FIG. 1.

To assemble the metal mesh portion 122 into the four sided cage as illustrated in FIGS. 1, 2 and 4, the metal mesh portion 122 is bent along the broken lines 126. The metal mesh portion 122 is also bent along the broken lines 124 in each of the flanges 114. The flanges 114 are bent in such a manner that the flanges 114*a–d* extend substantially perpendicular to the plane of the integral respective sides 112*a–e*. With the flanges 114 bent in this manner, the metal mesh portion 122 can then be bent along the broken lines 126 such that the two sides 112 adjacent to the respective broken lines 126 are substantially perpendicular to one another to form a substantially rectangularly shaped figure. For example, the section of the metal mesh portion 122 between sides 112*a* and 112*b* is bent so that side 112*a* is substantially perpendicular to side 112*b*; the section of the metal mesh portion 122 between sides 112*b* and 112*c* is bent so that side 112*b* is substantially perpendicular to side 112*c*; the section of the metal mesh portion 122 between sides 112*c* and 112*d* is bent so that side 112*c* is substantially perpendicular to side 112*d*; and, the section of the metal mesh portion 122 between sides 112*a* and 112*e* is bent so that side 112*a* is substantially perpendicular to side 112*e*.

In such a condition, the side portion 112*e* overlaps side 112*d* (FIGS. 2 and 4). The flange 114*e* integral to side portion 112*e* will overlap the flange 114*d* integral to side 112*d*. Overlapping portions of 112*e* and 112*d* are fastened to each other, preferably by resistance welds so that 112*e* is substantially integrated with side 112*d*. Then, overlapping portions of adjacent flanges 114 are fastened to each other, preferably by resistance welds. For example, the portion of flange 114*a* is fastened to 114*b*, flange 114*b* is fastened to flange 114*c*, flange 114*c* is fastened to flange 114*d*, and flange 114*d* is fastened to flange 114*a*.

Figure 6:
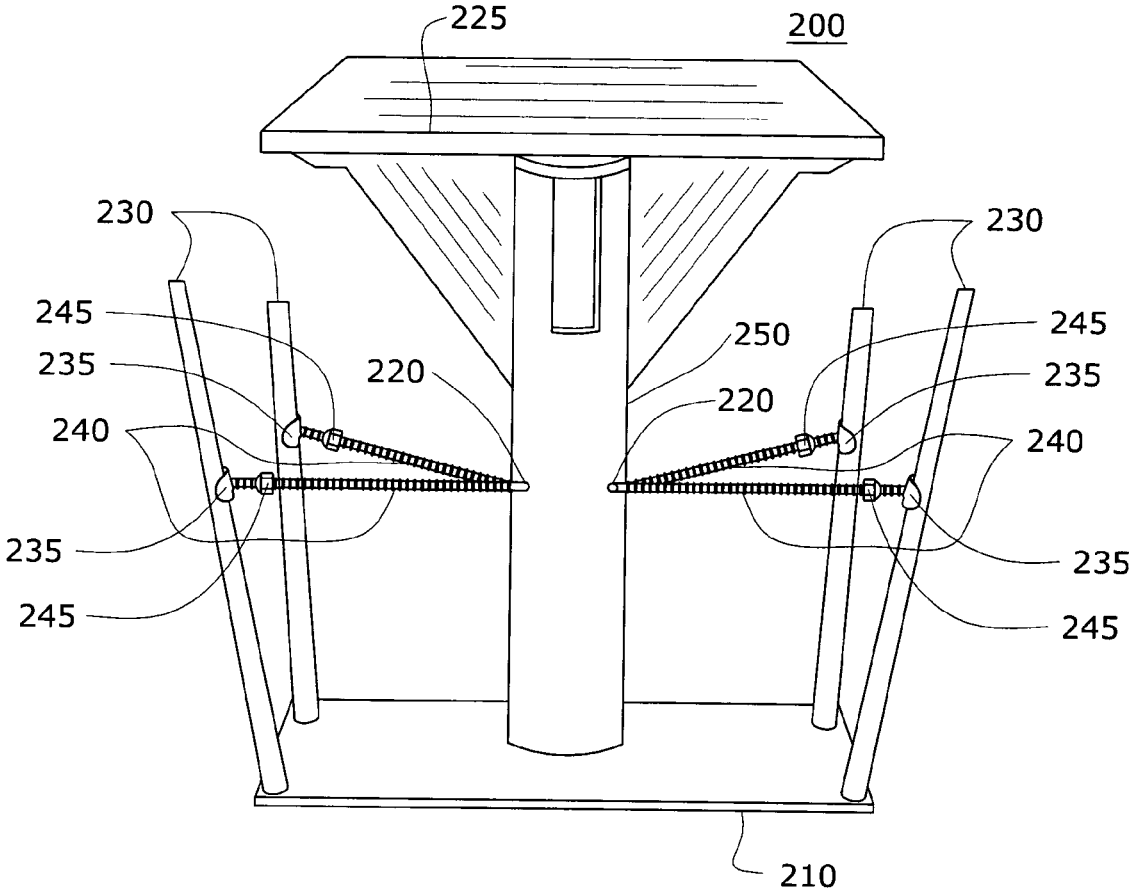
FIG. 6 is a perspective view of a stretching die used in the cap of FIG. 1.

Once in this condition, the cage 110 presents either a square or rectangular cross section. To achieve a trapezoidal shape for the cage 110 from top to bottom, the cage 110 is placed on a press machine with a tapered box-shaped stretching die 200. As shown in FIG. 6, the stretching die 200 is comprised of a planar base plate 210 which is smaller than the interior dimensions of the base of the cage 110, but large enough to be effective. A different stretching die 200 is preferred for each of a substantially rectangularly and a substantially square shaped cage 110.

Attached at each corner of the top side of the base plate 210 is an extension arm 230. The extension arms 230 are securely coupled yet attached in such a manner that permits adjusting the angle that they form with respect to the base plate 210. Each extension arm 230 is substantially perpendicular to the plane formed by the base plate 210 and the angle of each extension arm 230 with respect to the base plate can be adjusted. Attached substantially at the center of the base plate 210 is a central post 220. The central post 220 is substantially perpendicular to the base plate 210.

Threaded rods 240 are attached on one end through a respective threaded hole in the central post 220. A nut 245 is threaded onto each threaded rod 240 through a retaining ring 235 at a point away from where each extension arm 230 is attached to the base plate 210.

Rotating each nut 245 turns its respective threaded rod 240, which turns within the threads of its respective threaded hole in the central post 220 in which it is disposed. By this action of turning the threaded rod 240, a respective extension arm 230 is either pulled closer to or pushed farther away from the central post 220. Changing the distance between the central post 220 and the respective extension arm 230 adjusts the angle that the extension arm 230 forms with respect to the base plate 210.

In a preferred embodiment, the extension arms 230 are at least longer than the height of the cage 110, and preferably at least nine (9) inches. Furthermore, the angle of the extension arms is adjusted to effectuate a substantially five (5) degree angle of the sides 112 in the resulting trapezoidal shaped cage 110, e.g., where the top span of each side 112 of the cage 110 is slightly larger than the respective bottom span of each side 112 of the cage 110. It is also desirable that when using expanded metal for the metal mesh portion 122 that the longitudinal orientation of the diamond formed in an expanded metal be in a vertical orientation.

Figure 11:
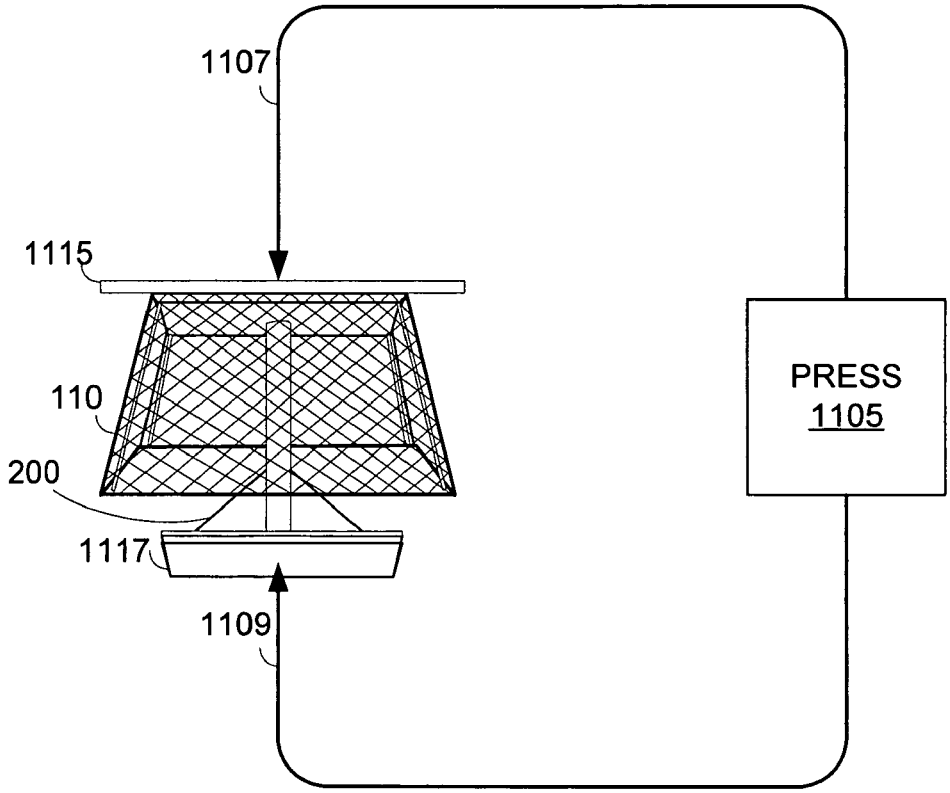
FIG. 11 is a schematic view illustrating a cage on a press machine with a tapered box-shaped stretching die of FIG. 6 in accordance with a preferred embodiment of the invention.

FIG. 11 is a schematic view illustrating a cage on a press machine 1105 with a tapered box-shaped stretching die 200 of FIG. 6 in accordance with a preferred embodiment of the invention. A press machine 1105 is a machine conventionally known to make chimney cap parts. The cage 110 and stretching die 200 are positioned in the press machine 1105, between a first side 1115 of the press machine 1105 and a second side 1117 of the press machine 1105. During a pressing operation, the press machine 1105 exerts a force on the first side 1115 in the direction indicated by the arrowhead of line 1107 and a force on the second side 1115 in the direction indicated by the arrowhead of line 1109. As the press machine 1105 applies pressure, the stretching die is pressed into the cage 110 thereby shaping the cage 110.

Figure 7:
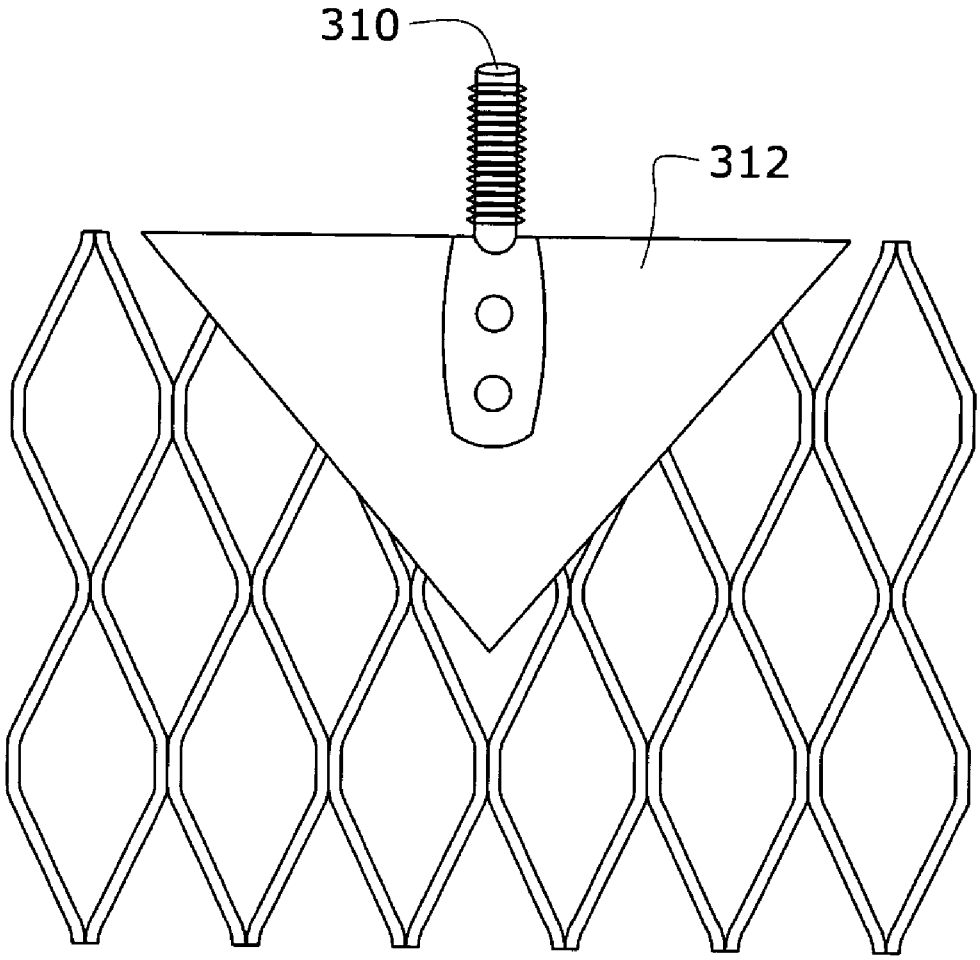
FIG. 7 is a securing stud and placement pad shown in greater detail as used in the cap of FIG. 1.

After the cage 110 has been shaped, in a preferred embodiment, a fastening stud 310 is attached to each side 112*a–d* at the top. As seen in FIG. 7 (and in FIGS. 1, 2 and 4) each stud 310 is resistance welded to a placement pad 312, which in turn is welded to a respective side 112. The studs 310 are positioned on the sides 112*a–d* to correspond to the openings, e.g., holes, 146 in the lid 140 (FIG. 3). In a preferred embodiment, the placement pad 312 is a three (3)

inch by one and a half (1.5) inch triangle of twenty four gauge stainless steel and is fastened to the exterior of each respective side.

In a preferred embodiment, the initial perforated material used in section 122 is twelve (12) inches wide and is either fifty four (54) or seventy (70) inches in length, depending on whether the desired resulting end product is substantially square or rectangular, respectively. The perforated material is expanded eighteen (18) gauge AISI 304 or 304L stainless steel or galvanel coated carbon steel mesh.

Figure 8:
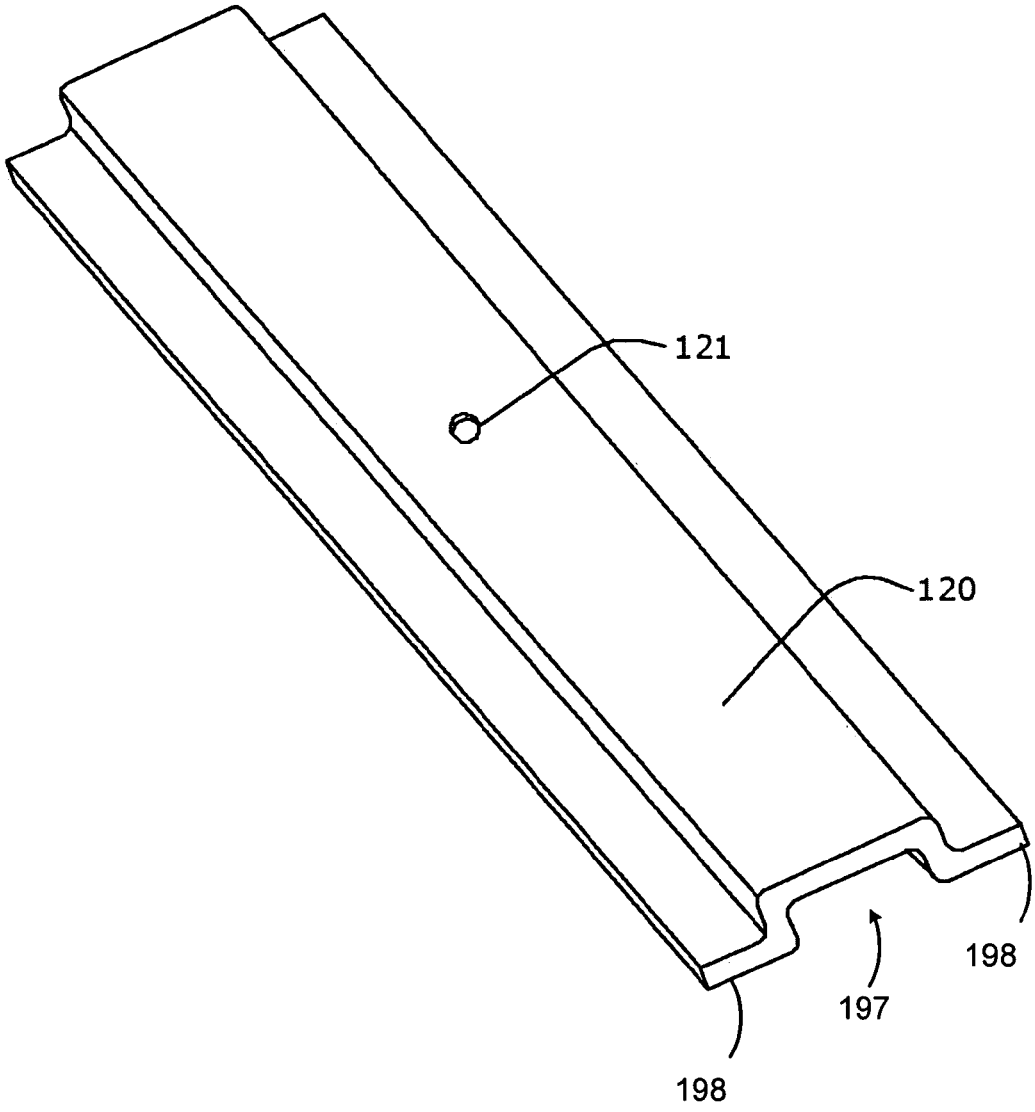
FIG. 8 is a strongback shown in greater detail as used in the cap of FIG. 1.

In FIG. 8, the strongback 120 is shown. The strongback 120 is a slotted metal portion with a channel 197 sandwiched by two flanges 198 and having a hole 121. The strongback 120 is placed channel side down across the bottom of the cage 110, substantially in the middle both in terms of length and width, effectively 'bridging' a flange 114 on one side with a flange 114 on the opposite side of the cage 110. The strongback 120 is secured to the portion of the flanges 114 farthest from the lid 140. The strongback 120 is preferably welded to the flanges 114. In a preferred embodiment, the strongback 120 is formed from twelve gauge stainless steel, has two (2) half (½) inch flanges.

Figure 9:
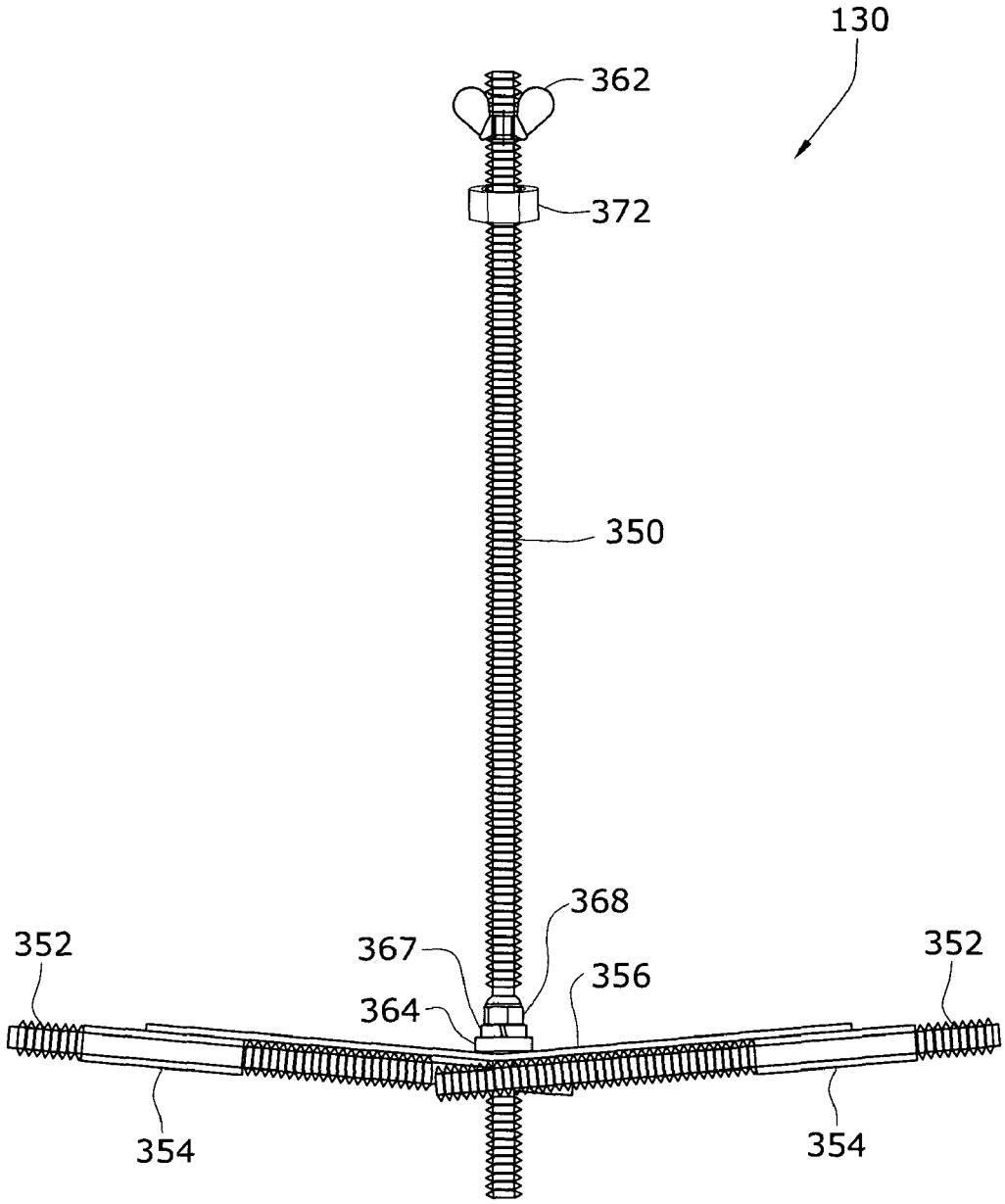
FIG. 9 is a securing means shown in greater detail as used in the cap of FIG. 1.

In order to fasten the cage 110 to a chimney flue, a securing mechanism is required. As seen in FIG. 9, a securing mechanism 130 is shown to be a V-type bracket assembly. The securing mechanism 130 has a V-shaped bracket 356 having a hole 366 (not shown) substantially in the center of the bracket 356. A weld nut 364 is fastened to the face of the bracket 356 such that their respective holes are aligned. A coupling nut 354 is attached by its exterior at each end of the bracket 356 such that the hole of each nut 354 is substantially parallel to the bracket 356. Two threaded rods 352 are threaded into a respective coupling nut 354. The threaded rod 350 is threaded through nut 364 and through the hole 366 of the bracket 356. A lock nut 368 is threaded onto a rod 350 until it is snug to the bracket 356. A wing nut 362 is threaded onto the rod 350 above a washer 372 and is used to secure the cage 110 through the strongback 120 to the flue tile.

In a preferred embodiment, the bracket 356 is constructed of twelve gauge stainless steel and is at a transverse angle from the plane perpendicular to the rod 350. Preferably, the bracket 356 is at a five degree angle from the plane perpendicular to the rod 350 (i.e., eighty-five degrees from the rod 350). The threaded rods 352 are at least six (6) inches in length and the threaded rod 350 is at least twelve (12) inches in length.

Figure 10:
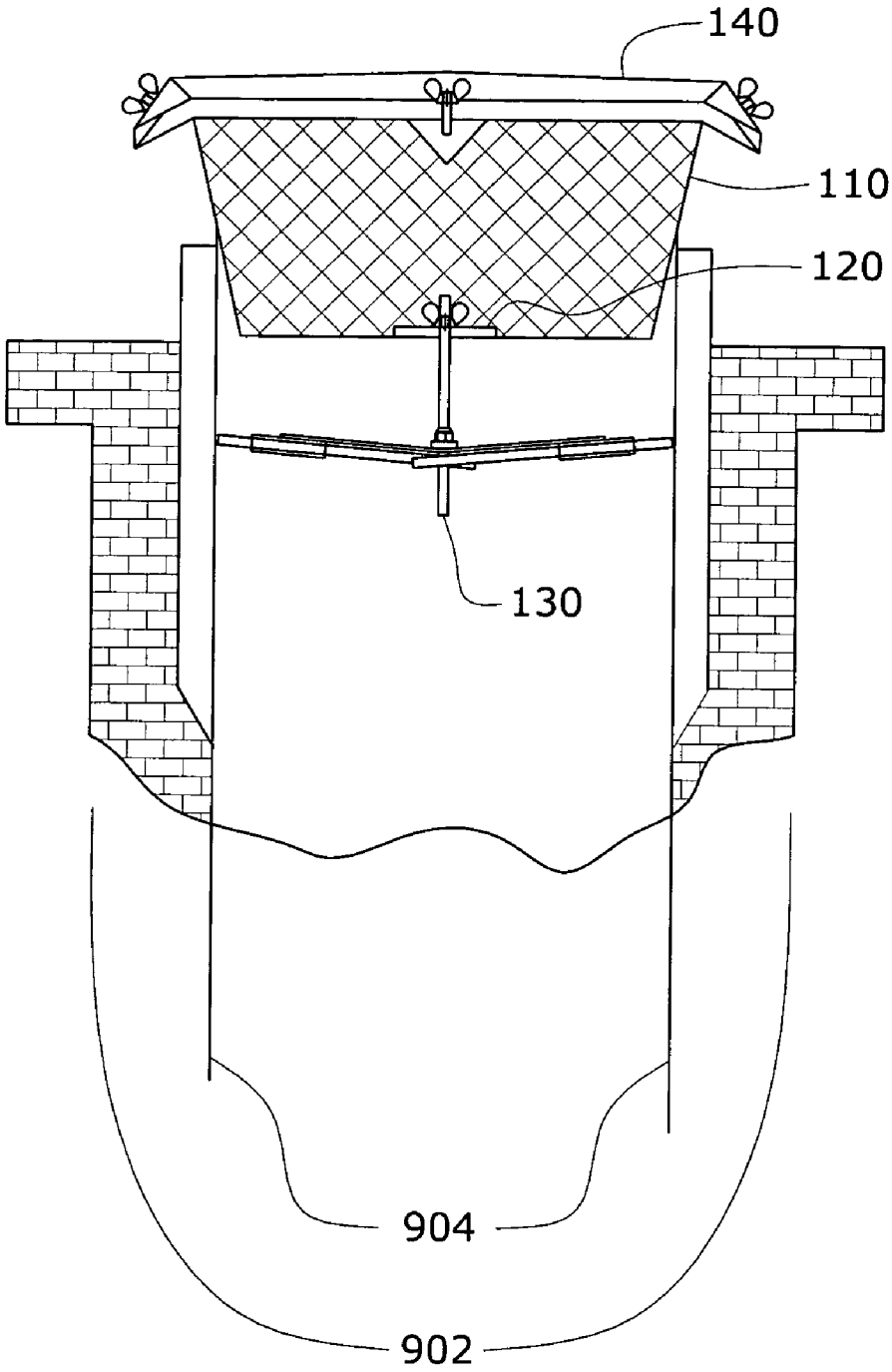
FIG. 10 is a perspective view of an installation of the cap of FIG. 1 into a chimney.

Use of the chimney cap 100 is shown, for example, in FIG. 10. The cage 110 is adapted to be disposed with a portion of its bottom to be within a flue tile 904 which is within a chimney 902. The securing mechanism 130 secures the cage 110 to the flue tile 904.

One preferred method for installing a chimney cap 100 is next described. To install the chimney cap 100, one must first measure the inside diameter or inside width of the flue tile 904 at the center of the flue. The rods 352 are then adjusted such that the rods 352 are all an equal distance from the center of the chimney cap 100 and such that the distance between the far end of one rod 352 to the far end of the other rod 352 is one half (½) inch greater than the inside width or diameter of the flue tile 904. The rod 350 is then threaded through the bracket 356 until approximately one half (½) inch of the rod 350 is through the bracket 356. Then the lock nut 368 is threaded onto the rod 350 until it is snug to the bracket 356. The opposing end of the rod 350, e.g., the end opposing the end of the rod 350 that is threaded through the bracket 356, is then fed through the bottom of cage 110 and through the hole 121 of the strongback 120. A washer 372 and a wing nut 362 are then placed an one and a half (1½) inches onto the other end of rod 350. The cage 110 is then placed on the flue tile 904 and the bracket 356 is pushed down into the flue tile 904 as far as it will go, making sure that the bracket 356 is directly below and parallel to the strongback 120. The wing nut 362 is tightened on the rod 350 until the wing nut 362 is securely against the strongback 120. The holes 146 of the lid 140 are then properly oriented with their respective studs 310, and the lid 140 is placed onto the cage 110. The lid by 140 is then secured by threading and tightening respective washers and wing nuts (FIGS. 1, 2 and 10). The strongback 120 connects the cage 110 to the flue by pressure exerted though the securing mechanism 130 to the sides of the flue tile 904.

Therefore, a chimney cap embodiment of the present invention is more consistently shaped, more accurately shaped and more easily nested. The resulting caps also do not require excessively sized lids to compensate for that lack of uniformity among chimney caps. While the invention has been described and illustrated with reference to specific exemplary embodiments, it should be understood that many modifications and substitutions can be made without departing from the spirit and scope of the invention. Although the embodiments discussed above describe preferred angles, size, shape, and specific numbers of sides, bends, fasteners, etc. the present invention is not so limited. Furthermore, the cage 110 may not only be disposed within the chimney 902, but may also be disposed on top of the chimney 902. Accordingly, the invention is not to be considered as limited by the foregoing description but is only limited by the scope of the claims.

What is claimed as new and desired to be protected by Letters Patent of the United States is:

1. A chimney cap, comprising:

a cage formed from one piece of substantially flat perforated rectangularly shaped metal, said metal bent to form a substantially rectangularly configured box, opposites sides of said box being substantially similar in size, each side of said box having an integral flange that extends perpendicular to its respective side, said cage being expanded such that each side of said box is trapezoidal in shape, where the top span of at least one side of said box is larger than the bottom span of said at least one side of said box;

a securing mechanism adapted to securing said cage to inside a flue;

a strongback fastened to a pair of opposite flanges of said sides of said box, said strongback adapted to receive said securing mechanism, said strongback comprising a channel and two flanges;

wherein said securing mechanism further comprises:

a bracket;

a first rod positioned in a first direction and threaded vertically through said bracket; and second and third rods each attached to said bracket in a second direction transverse from said first direction.

2. The cap of claim 1, wherein said bracket is V-shaped.

3. The cap of claim 1, wherein all of said sides of said box are substantially similar in size.

4. The cap of claim 1, wherein said one piece of substantially flat perforated rectangularly shaped metal comprises mesh.

5. The cap of claim 1, wherein said one piece of substantially flat perforated rectangularly shaped metal comprises expanded metal.

6. The cap of claim 1, wherein a portion of said cage is adapted to fit in said flue.

7. The cap of claim 1, wherein a portion of said cage is adapted to fit on top of said flue.

8. A method of making a chimney cap comprising the steps of:

forming a cage, comprising the steps of:

bending a substantially flat, rectangularly shaped perforated metal to form a substantially rectangularly shaped box having four sides;

bending flanges integral to each side of said box to be substantially perpendicular to said respective side; and pressing said cage in a press machine with a taper-shaped die to form a tapered cage.

9. The method of claim 8, further comprising fastening overlapping portions of said sides of said cage.

10. The method of claim 9, wherein said fastening of said overlapping portions of said cage comprises welding.

11. The method of claim 9, further comprising forming a lid adapted to be connected to a top of said cage.

12. The method of claim 11, further comprising forming a mechanism to secure said cage to a flue of a chimney.

13. The method of claim 12, wherein said taper-shaped die comprises:

a base plate, wherein said base plate is substantially flat and corresponds to the size of the bottom of said cage;

four extensions arms, each arm connected near a respective corner of a top side of said base plate, each said arm substantially perpendicular to a plane formed by the base plate;

a center post in substantially the center of said top side of said base plate; and four arm adjusters, each said arm adjuster connected on one end to a respective arm and on an opposing end to said center post.

14. The method of claim 8, wherein said bending said metal step occurs before bending said flanges step.

15. The method of claim 14, wherein said bending said flanges step occurs before pressing said cage step.

* * * * *